United States Patent [19]

Lo

[11] Patent Number: 4,837,892

[45] Date of Patent: Jun. 13, 1989

[54] CUSHIONED HANDLE STRUCTURE FOR PERSONAL CARE APPLIANCES

[75] Inventor: Hou-On Lo, Kowloon, Hong Kong

[73] Assignee: Conair Corporation, Stamford, Conn.

[21] Appl. No.: 164,193

[22] Filed: Mar. 4, 1988

[51] Int. Cl.[4] ..... B25G 3/00

[52] U.S. Cl. ..... 16/116 R; 16/111 R; 16/DIG. 12; 16/DIG. 24; 30/343; 273/81 B; 74/551.9; 403/267

[58] Field of Search ..... 16/111 R, 116 R, DIG. 12, 16/DIG. 24; 30/343; 273/75, 81 B, 81 R; 74/551.9; 403/265, 267

[56] References Cited

U.S. PATENT DOCUMENTS

| | | | |
|---|---|---|---|
| 1,728,619 | 9/1929 | Lambert | 30/343 |
| 2,236,414 | 3/1941 | Reach | 273/81 B |
| 2,382,304 | 8/1945 | Foltz et al. | 30/343 |
| 2,520,355 | 8/1950 | Bell | 30/343 |
| 3,692,155 | 9/1972 | Laurita | 190/57 |
| 4,004,476 | 1/1977 | DeVrou | 81/177 A |
| 4,081,038 | 3/1978 | Andersson et al. | 16/116 R |
| 4,147,443 | 4/1979 | Skobel | 403/267 |

FOREIGN PATENT DOCUMENTS

| | | | |
|---|---|---|---|
| 1223034 | 6/1960 | France | 16/116 R |

*Primary Examiner*—Nicholas P. Godici
*Assistant Examiner*—Edward A. Brown
*Attorney, Agent, or Firm*—Haynes N. Johnson

[57] ABSTRACT

A cushioned handle structure for use in personal care appliances including two plastic understructure halves having outer and inner surfaces, each half having a plurality of holes running between the two surfaces. An elastomeric material is integrally formed as an overlay in contact with the outer surface and is integrally continued as plugs in the holes so that the overlay is held in position in contact with the outer surface by the plugs. The holes may be undercut proximate to the inner surfaces or be continued as channels on the inner surfaces to provide greater integrity.

4 Claims, 1 Drawing Sheet

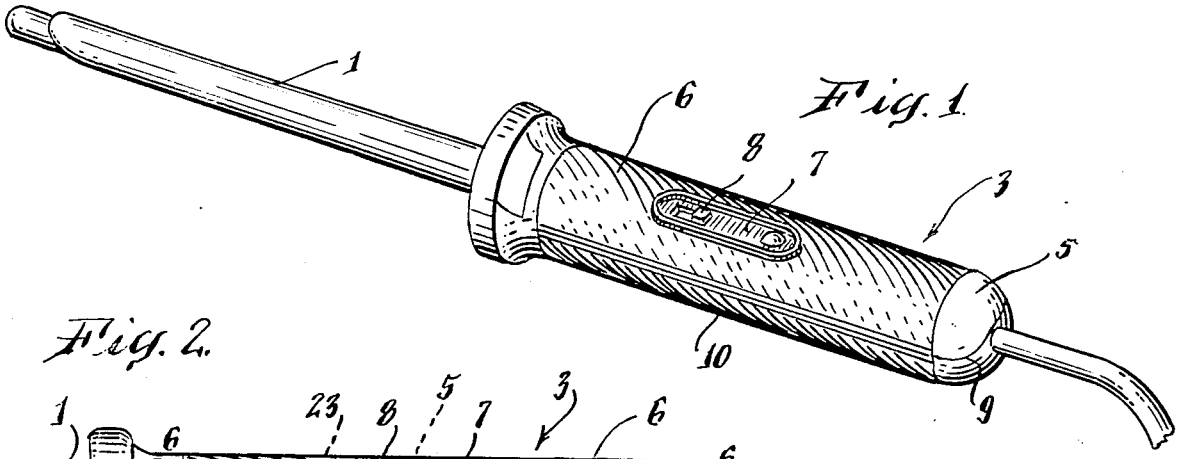
Fig. 1.
Fig. 2.
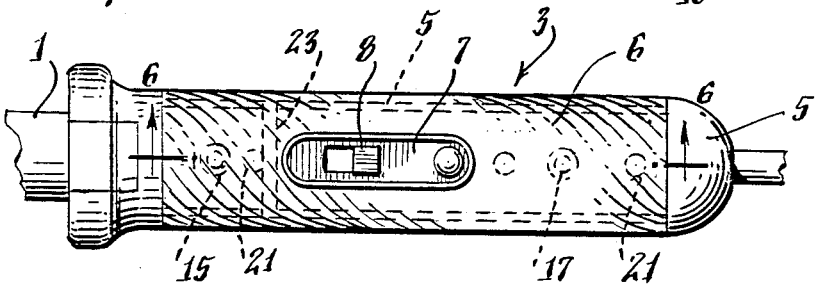
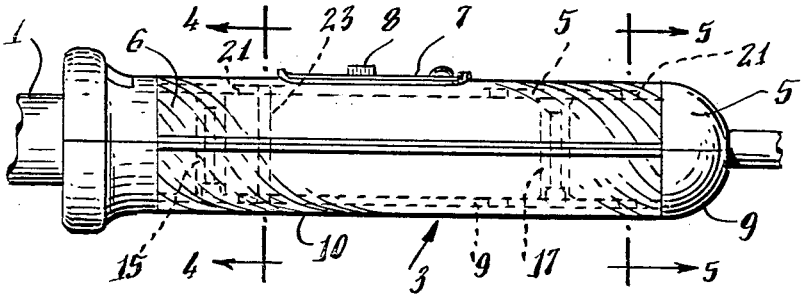
Fig. 3.
Fig. 4.
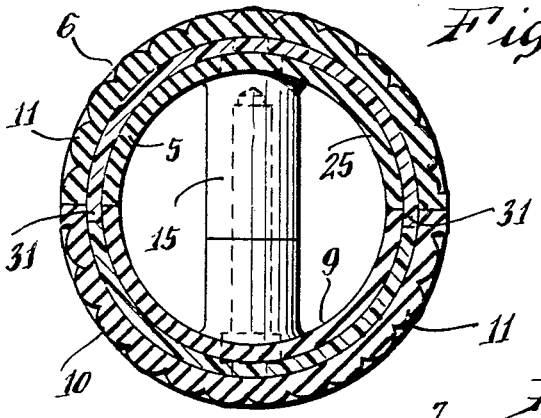
Fig. 5.
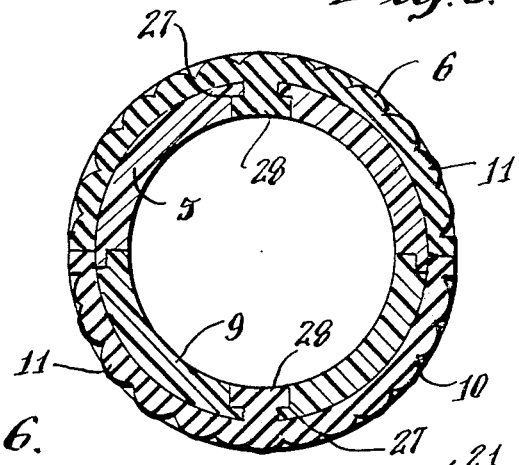
Fig. 6.
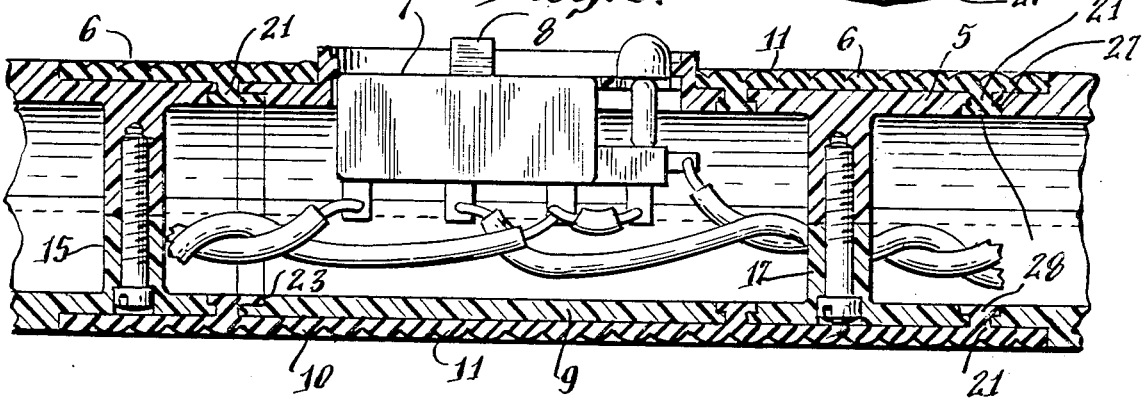

CUSHIONED HANDLE STRUCTURE FOR PERSONAL CARE APPLIANCES

FIELD OF THE INVENTION

This application relates to the field of personal care appliances and, in particular, to cushioned handle structures that reduce motor vibration going to the user's hand, are comfortable to hold, and provide for a sure grip.

BACKGROUND OF THE INVENTION

In using personal care appliances, such as hair dryers and curling irons, the user often must hold the appliance for extended periods of time. Convenience and comfort in holding it, therefore, become factors to consider. Consequently, cushioning of some type is desireable.

Cushioned handles as such are not new. For example, DeVrou U.S. Pat. No. 4,004,476 discloses a sleeve-type cushion which slips over a socket wrench extension; and Laurita U.S. Pat. No. 3,692,155 discloses a cushioned handle for luggage in which the cushion is held in place by a rigid channel at the edges of the handle. These, however, are not directed to the problem of adhering an elastomeric cushioning material to a plastic understructure, as is required in the manufacture of personal care appliances.

BRIEF SUMMARY OF THE INVENTION

One method of cushioning the handle structures is to provide them with a soft, rubbery or elastomeric outer surface. This, however, is not easily accomplished since rubber and elastomeric compounds often do not readily adhere, and remain adhered to, the usual plastic understructure of the handles.

I have found that by providing the plastic handle understructure with interstices through which the rubber can flow during the molding process will provide gripping undersurfaces that adequately engage the rubber and hold it in place. In addition, the interstices may be undercut or, preferably, channeled to enhance adherence.

DESCRIPTION OF THE DRAWINGS

FIG. 1 is a perspective view of my handle structure in which it is used, by way of illustration, in a hair curler.

FIG. 2 is a plan view of the handle itself.

FIG. 3 is a side elevation of the handle.

FIG. 4 is a vertical section taken on line 4—4 of FIG. 3.

FIG. 5 is a vertical section taken on line 5—5 of FIG. 3.

FIG. 6 is a vertical section taken on line 6—6 of FIG. 2.

DETAILED DESCRIPTION OF THE INVENTION

A personal care appliance such as a curling iron 1 has a handle portion or structure 3. Handle structure 3 is formed of two molded plastic halves, upper half 5 and lower half 9, both of which have been formed with space to receive and hold rubber or a similar elastomeric composition.

The rubber is molded in place on each half, with rubber overlay area 6 on upper half 5 and rubber overlay area 10 on lower half 9. Upper half 5 includes a switch area 7 (not covered with rubber) with switch button 8. If desired, the rubber portions can be molded with gripping grooves, such as diagonal grooves 11.

The two halves 5 and 9 are secured together with forward and rear screw joiners 15 and 17 of the usual type.

The problem, however, has been that rubber or elastomeric compounds often do not adhere permanently to the underlying plastic halves and, over time, tend to separate from the plastic. Rather than trying various types of adhesives to solve the problem, I have found that the bond can be made permanent by providing for a series of holes or holes with undercut areas in the plastic molded halves 5 and 9. These undercut areas receive rubber during the rubber molding step and so provide rubber holding plugs or locking areas.

One type of holding plug is a plurality of holes or interstices 21 in the halves running from the outer surface to the inner surface of the halves. During molding of the rubber, these receive a plug of rubber which is integral with its respective rubber areas 6 or 10, thus holding the rubber areas tightly bound to the halves 5 and 9.

The interstices 21 can lead to undercut structures in the plastic halves, and so receive more of the rubber or elastomer thus providing a greater bond. One type of undercut may be a groove 23 running along the inner surface of the half and connected to one or more holes 21. This groove may run the full width of its half or only part of the width. If it runs the full width, it can join the rubber area 6 or 10 at a joinder area 31 at its edges as well as at the hole 21. Here, when the rubber is molded into place, it also passes through hole 21, beneath the half in groove 23 and, at the end of the groove, again joins the rubber area.

An alternate system of undercutting is simply to have an enlarged undercut area 27 at the inside end of hole 21. This will then receive rubber during molding and serve to secure the rubber area in place. If desired, both systems can be used in a single handle structure, as shown in the drawings.

I claim:

1. A handle structure for use in personal care appliances, said handle structure including a plastic understructure having outer and inner surfaces, said understructure having a plurality of holes running between said two surfaces, an elastomeric material integrally molded as an overlay in contact with said outer surface and as plugs molded in said holes, and at least one channel molded in said inner surfaces, said channel connecting directly to at least one said hole, said channel having elastomeric material therein and integral with said plug in said hole.

whereby said overlay is held in position in contact with said outer surface by said plugs.

2. A handle structure as set forth in claim 1 in which said channel runs to the outer edge of said inner surface and said elastomeric material in said channel is connected to said elastomeric material in said overlay at said outer edge.

3. A handle structure for use in personal care appliances, said handle structure including a plastic understructure having outer and inner surfaces, said understructure having a plurality of holes running between said two surfaces, said holes being enlarged and undercut proximate to said inner surface, and an elastomeric material integrally molded as an overlay in contact with said outer surface and as plugs molded in said holes, whereby said overlay is held in position in contact with said outer surface by said plugs.

4. A handle structure as set forth in claim 3 in which said plastic understructure is formed of two halves and said halves are secured together.

* * * * *